US011170683B2

(12) United States Patent
Han et al.

(10) Patent No.: US 11,170,683 B2
(45) Date of Patent: Nov. 9, 2021

(54) DISPLAY DRIVING IC AND OPERATING METHOD THEREOF

(71) Applicant: SAMSUNG ELECTRONICS CO., LTD., Suwon-si (KR)

(72) Inventors: Byung Hun Han, Suwon-si (KR); Mi Ran Kim, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 16/674,250

(22) Filed: Nov. 5, 2019

(65) Prior Publication Data

US 2020/0320917 A1 Oct. 8, 2020

(30) Foreign Application Priority Data

Apr. 8, 2019 (KR) ..... 10-2019-0040971

(51) Int. Cl.
*G09G 3/20* (2006.01)
*G09G 5/395* (2006.01)
*G09G 5/393* (2006.01)

(52) U.S. Cl.
CPC ..... *G09G 3/20* (2013.01); *G09G 5/393* (2013.01); *G09G 5/395* (2013.01); *G09G 2310/08* (2013.01); *G09G 2360/12* (2013.01)

(58) Field of Classification Search
CPC ..... G09G 3/20; G09G 5/395; G09G 5/393; G09G 2360/12; G09G 2310/08; G09G 2360/16; G09G 2310/04; G09G 2320/0613; G09G 2330/021; G09G 2360/18
See application file for complete search history.

(56) References Cited

U.S. PATENT DOCUMENTS 4,764,975 A * 8/1988 Inoue ..... G06T 3/40 345/670
5,864,336 A * 1/1999 Yano ..... G06F 3/147 345/536
7,295,178 B2 11/2007 Nakano et al.
8,314,632 B1 * 11/2012 Liu ..... H03K 19/0013 326/21
8,564,555 B2 * 10/2013 Day ..... G06F 3/0416 345/173
9,734,775 B2 8/2017 Davis et al.
(Continued)

FOREIGN PATENT DOCUMENTS

JP 2004287351 10/2004
JP 2008165052 7/2008
(Continued)

*Primary Examiner* — Maurice L. McDowell, Jr.
*Assistant Examiner* — Donna J. Ricks
(74) *Attorney, Agent, or Firm* — F. Chau & Associates, LLC

(57) ABSTRACT

An operating method of a display driving integrated circuit (DDIC) includes correcting first image data using correction data in a first operating mode. The first image data is received from a processor via an interface, and the correction data is stored in a first memory included in the DDIC. The method further includes storing second image data received from the processor in the first memory in response to a mode switching signal controlling the DDIC to switch to a second operating mode, and displaying the second image data on a display panel in the second operating mode.

20 Claims, 9 Drawing Sheets

(56) References Cited

U.S. PATENT DOCUMENTS

| | | | | |
|---|---|---|---|---|
| 9,858,898 | B2 | 1/2018 | Chen et al. | |
| 2007/0200818 | A1 | 8/2007 | Miyamoto et al. | |
| 2008/0111773 | A1* | 5/2008 | Tsuge | G09G 3/3241 345/76 |
| 2010/0053145 | A1* | 3/2010 | Morita | G09G 3/3688 345/213 |
| 2018/0053463 | A1 | 2/2018 | Kong et al. | |
| 2018/0060175 | A1 | 3/2018 | Kim et al. | |
| 2018/0122296 | A1 | 5/2018 | Lee | |
| 2019/0392781 | A1* | 12/2019 | Hsu | G09G 5/363 |

FOREIGN PATENT DOCUMENTS

| | | | | |
|---|---|---|---|---|
| KR | 2017 0008698 A | * | 1/2017 | G09G 3/20 |
| KR | 10-2018-0021358 | | 3/2018 | |
| KR | 10-2018-0024626 | | 3/2018 | |
| KR | 10-2018-0047860 | | 5/2018 | |
| KR | 10-2018-0109626 | | 10/2018 | |

* cited by examiner

DISPLAY DRIVING IC AND OPERATING METHOD THEREOF

CROSS-REFERENCE TO RELATED APPLICATIONS

This application claims priority under 35 U.S.C. § 119 to Korean Patent Application No. 10-2019-0040971, filed on Apr. 8, 2019 in the Korean Intellectual Property Office, the disclosure of which is incorporated by reference herein in its entirety.

TECHNICAL FIELD

Exemplary embodiments of the present disclosure relate to a display driving integrated circuit (DDIC), and an operating method thereof.

DISCUSSION OF THE RELATED ART

A flat panel display device may be used in an electronic device such as, for example, a television, a laptop computer, a monitor, a mobile device, etc. to display an image. Examples of a flat panel display device include a liquid crystal display (LCD), an organic light-emitting display (OLED), etc.

A flat panel display device may include a panel having a plurality of pixels, and a driving device for supplying an electrical signal to the pixels. An image may be formed by the electrical signal supplied to the pixels from the driving device. The flat panel display device may display either image data received continuously from a processor, or image data stored in an internal memory thereof, according to an operating mode of the driving device.

SUMMARY

Exemplary embodiments of the present disclosure provide a display driving integrated circuit (DDIC) with an internal memory capable of performing both a function of an image correction look-up table and a function of an image storage buffer according to an operating mode.

According to an exemplary embodiment, an operating method of a display driving integrated circuit (DDIC) includes correcting first image data using correction data in a first operating mode. The first image data is received from a processor via an interface, and the correction data is stored in a first memory included in the DDIC. The method further includes storing second image data received from the processor in the first memory, in response to a mode switching signal controlling the DDIC to switch to a second operating mode, and displaying the second image data on a display panel in the second operating mode.

According to an exemplary embodiment, an operating method of a DDIC includes correcting first image data using correction data stored in an internal memory of the DDIC. The first image data is received from a processor and includes a plurality of image frames. The method further includes displaying the corrected first image data on a display panel. The method further includes storing, as second image data, at least one image frame, among the plurality of image frames in the internal memory, which is not displayed on the display panel, in response to a first mode switching signal. The method further includes receiving third image data from the processor when an update condition is satisfied, and updating the second image data with the third image data.

According to an exemplary embodiment, an operating method of a DDIC includes receiving first image data and second image data from a processor via an interface, correcting the first image data using correction data obtained from an internal memory of the DDIC, displaying the corrected first image data on a display panel, and deactivating the interface and storing the second image data in the internal memory.

According to an exemplary embodiment, a DDIC includes an interface that communicates with a processor, and a first memory that stores either correction data for correcting image data received from the processor or the image data. The first memory is connected to the interface. The DDIC further includes a timing controller that inputs the image data to a display panel in response to a timing control signal, and a controller that controls whether to activate the interface according to an operating mode of the DDIC.

BRIEF DESCRIPTION OF THE DRAWINGS

The above and other features of the present disclosure will become more apparent by describing in detail exemplary embodiments thereof with reference to the accompanying drawings, in which.

DETAILED DESCRIPTION

Figure 1:
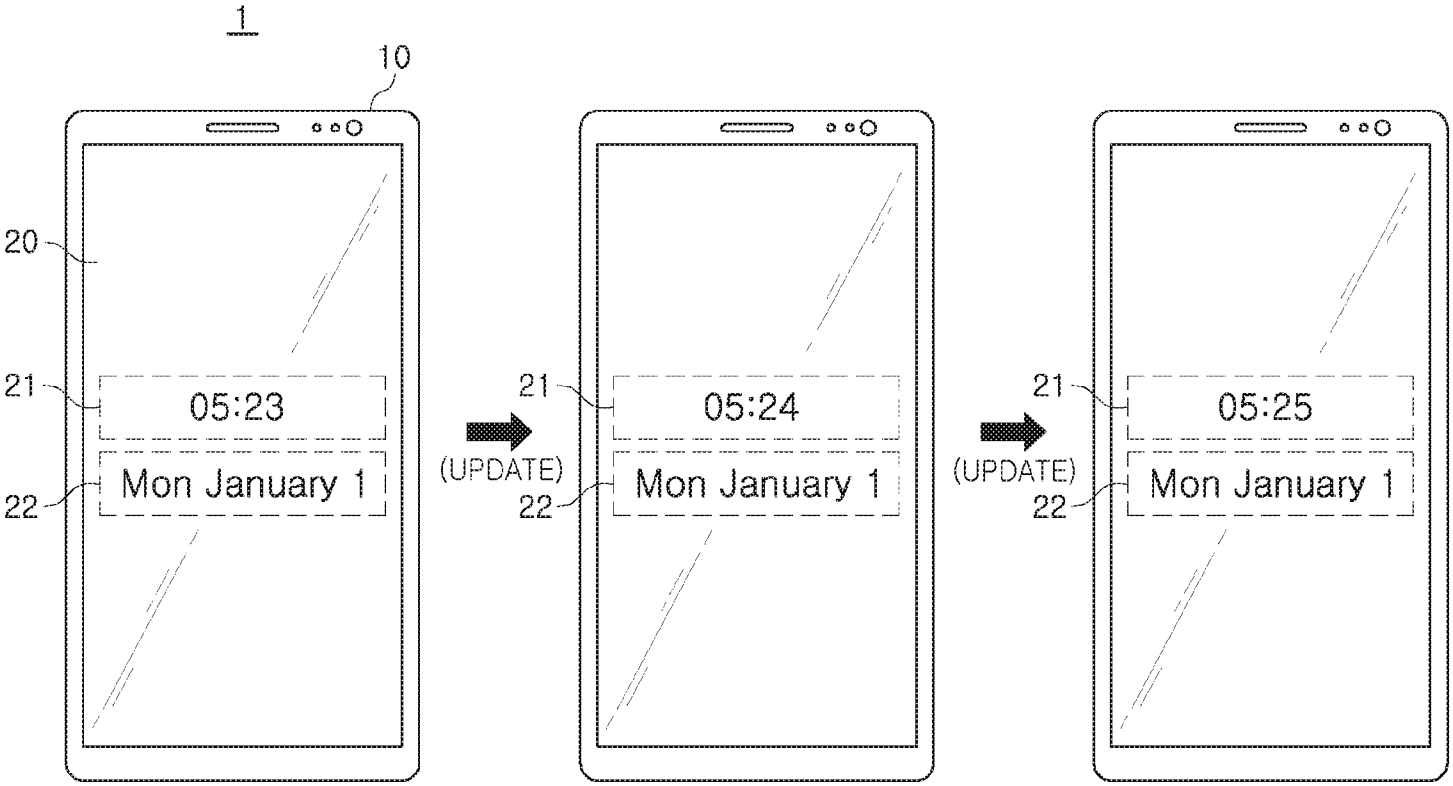
FIG. 1 is a diagram illustrating an electronic device to which a display driving integrated circuit (DDIC) according to an exemplary embodiment is applied.

Exemplary embodiments of the present disclosure will be described more fully hereinafter with reference to the accompanying drawings. Like reference numerals may refer to like elements throughout the accompanying drawings.

It will be understood that the terms "first," "second," "third," etc. are used herein to distinguish one element from another, and the elements are not limited by these terms. Thus, a "first" element in an exemplary embodiment may be described as a "second" element in another exemplary embodiment.

FIG. 1 is a diagram illustrating an electronic device to which a display driving integrated circuit (DDIC) according to an exemplary embodiment is applied.

Referring to FIG. 1, an electronic device 1 may be embodied as a mobile device such as, for example, a smartphone, and may include a housing 10 and a display panel 20.

The housing 10 may form the shape of the electronic device 1. The housing 10 may include, for example, a first surface, a second surface opposite the first surface, and side surfaces disposed between the first surface and the second surface.

The display panel 20 and a cover glass may be sequentially arranged on the first surface of the housing 10. The display panel 20 may be exposed externally via the cover glass. The electronic device 1 may include a processor and a DDIC, which are included in the housing 10. The processor may control overall operations of the electronic device 1. The DDI may drive the display panel 20 to display various types of image data such as, for example, still images, videos, and text. A rear cover may be disposed on the second surface of the housing 10. The side surfaces of the housing 10 may function as antenna radiators.

The electronic device 1 may operate in various operating modes. For example, the electronic device 1 may operate in an active mode (also referred to as a wake-up mode or a normal mode) or a sleep mode.

In an active mode, the electronic device 1 may perform various functions by supplying sufficient power to various hardware modules and/or software modules. For example, in the active mode, the electronic device 1 may display various image data provided from the processor on the display panel 20. The image data displayed on the display panel 20 may be data obtained by correcting original image data on the basis of correction data stored in an internal memory of the DDIC.

In the sleep mode, the electronic device 1 may perform a limited number of functions by deactivating at least some of the various hardware modules and software modules thereof. For example, in the sleep mode, the electronic device 1 may display only limited information, such as, for example, time, weather, a remaining battery level, etc., on the display panel 20, based on image data stored in the internal memory of the DDIC. By displaying only limited information (e.g., high priority information), the electronic device 1 may consume less power and utilize less resources.

In an example of FIG. 1, the electronic device 1 is operating in the sleep mode, and may display, on the display panel 20, first image data 21 representing a current time and second image data 22 representing a current date. The first image data 21 may be received earlier than the second image data 22.

The first image data 21 and the second image data 22 may be stored in the internal memory of the DDIC before the electronic device 1 enters the sleep mode. The first image data 21 and the second image data 22 stored in the internal memory may be updated with current information (referred to as, for example, third image data) by the DDIC or the processor at certain time intervals, or whenever a certain event such as, for example, a user touch input occurs. In exemplary embodiments, the second image data 22 may be updated with the third image data during the sleep mode. The event that causes the update may be a predefined event, and is not limited to the occurrence of a user touch input. In the example of FIG. 1, the first image data 21 is updated at one-minute intervals, starting at 05:23, and the second image data 22 is not updated because the current date is 'Monday, January 1'.

In an exemplary embodiment, the internal memory of the DDIC may perform different functions in the active mode and the sleep mode of the electronic device 1. For example, in the active mode, the internal memory of the DDIC may store correction data for correcting image data. In this case, the DDIC may be used as a look-up table. Alternatively, in the sleep mode, the internal memory of the DDIC may store image data to be displayed on the display panel 20. In this case, the DDIC may be used as a display buffer. As described above, in the DDIC according to an exemplary embodiment, one internal memory may be used as an image correction memory or a buffer memory according to an operating mode, thereby reducing the size and power consumption of the DDIC. For example, unlike a comparative example in which a separate buffer is implemented for the purpose of displaying image data in a sleep mode, in exemplary embodiments, the same internal memory used as image correction memory in the active mode may also be used as a buffer memory in the sleep mode, reducing the size and power consumption of the DDIC.

Figure 2:
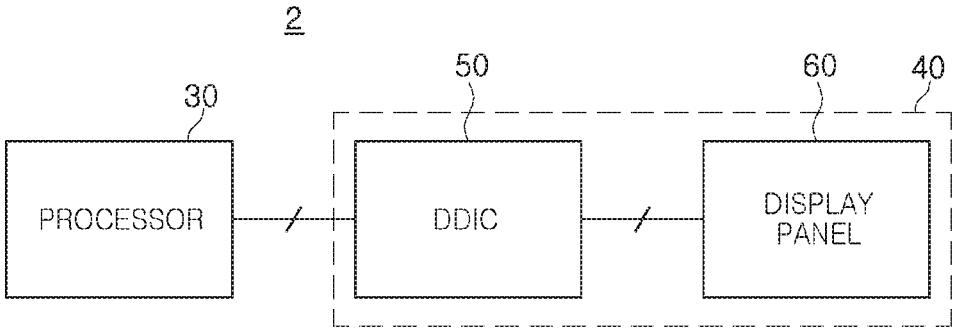
FIG. 2 is a schematic block diagram of a display system including a DDIC according to an exemplary embodiment.

FIG. 2 is a schematic block diagram of a display system including a DDIC according to an exemplary embodiment.

Referring to FIG. 2, a display system 2 according to an exemplary embodiment may include a processor 30 and a display device 40. The display device 40 may include a DDIC 50 and a display panel 60.

The processor 30 may include at least one of, for example, a central processing unit (CPU), an application processor (AP), or a communication processor (CP). For example, when the display system 2 is applied to a mobile device, the processor 30 may be the AP. When the display system 2 is applied to a desktop or a laptop computer, the processor 30 may be the CPU.

The processor 30 may control one or more components of the display system 2 to process various types of data. For example, the processor 30 may generate image data to be displayed on the display panel 60, or may receive the image data from a memory, a communication module, etc. and transmit the image data to the DDIC 50.

The display device 40 may include the DDIC 50 and the display panel 60. The DDIC 50 may include a gate driver and a source driver to input the image data transmitted from the processor 30 to the display panel 60. The DDIC 50 may further include a timing controller to control the gate driver and the source driver.

The timing controller may control the gate driver and the source driver according to a timing control signal. The timing control signal may be generated and transmitted by the processor 30 or may be generated by the timing controller.

The DDIC 50 may communicate with the processor 30 on the basis of a certain communication interface. In an exemplary embodiment, the DDIC 50 may communicate with the processor 30 on the basis of a high-speed serial interface such as, for example, a mobile industry processor interface (MIPI).

The DDIC 50 may operate in either a video mode in which both the image data and the timing control signal are received from the processor 30, or a command mode in which only the image data is received from the processor 30. In the video mode, the image data may be transmitted in real time from the processor 30 to the DDIC 50. In the command mode, the image data may be transmitted from the processor 30 to the DDIC 50 under control of a tearing effect (TE) signal. In the command mode, when the image data is a still image, the DDIC 50 may store the received still image in the internal memory, and display the still image on the display panel 60 from the internal memory.

Figure 3:
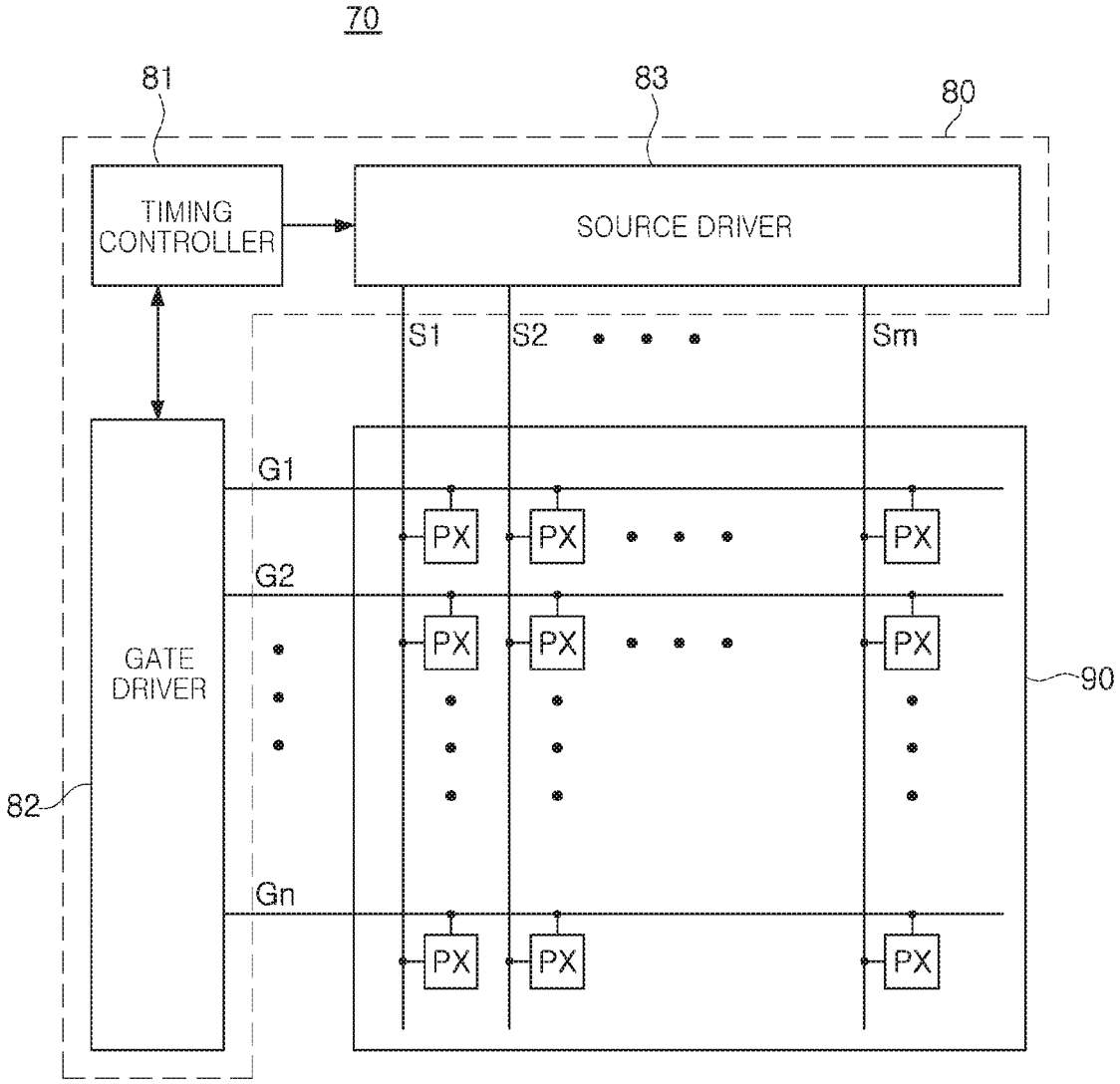
FIG. 3 is a schematic block diagram of a display device including a DDIC according to an exemplary embodiment.

FIG. 3 is a schematic block diagram of a display device including a DDIC according to an exemplary embodiment.

Referring to FIG. 3, a display device 70 may include a DDIC 80 and a display panel 90.

The DDIC 80 may include a timing controller 81, a gate driver 82, and a source driver 83. The display panel 90 may include a plurality of pixels PX arranged along a plurality of gate lines G1 to Gn and a plurality of source lines S1 to Sm, where n and m are positive integers.

In an exemplary embodiment, the display device 70 may display image data in units of frames. The time required to display one frame may be defined as a vertical period, and the vertical period may be determined by a scan rate of the display device 70. For example, when the scan rate of the display device 70 is 60 Hz, the vertical period may be 1/60 seconds (e.g., about 16.7 ms).

During one vertical period, the gate driver 82 may scan each of the gate lines G1 to Gn. The time required for the gate driver 82 to scan each of the gate lines G1 to Gn may be defined as a horizontal period, and the source driver 83 may input image data to the pixels PX during one horizontal period.

The horizontal period and the vertical period may be determined by the timing controller 81. When the DDIC 80 is connected to an external processor using the MIPI, the horizontal period and the vertical period may be determined by the timing controller 81 in the command mode. In contrast, in the video mode, the horizontal period and the vertical period may be determined by the external processor.

Figure 4:
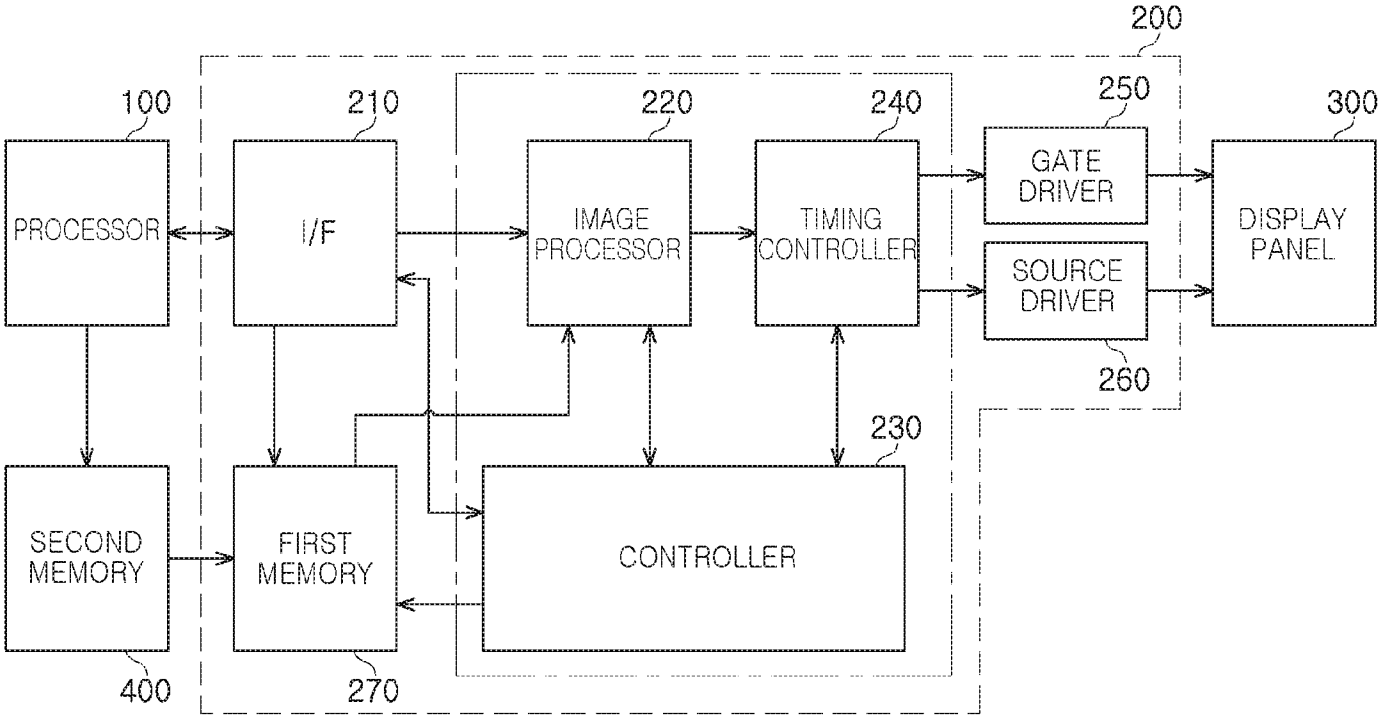
FIG. 4 is a schematic block diagram of a DDIC according to an exemplary embodiment.

FIG. 4 is a schematic block diagram of a DDIC according to an exemplary embodiment.

A DDIC 200 may operate in various operating modes such as a normal mode, a sleep mode, and a low power mode. For example, the DDIC 200 may operate in a first operating mode or a second operating mode according to a method of displaying image data. In the exemplary embodiments described herein, unless the context indicates otherwise, the first operating mode is the normal mode and the second operating mode is the sleep mode.

In the first operating mode, the DDIC 200 may display image data continuously received from a processor 100 on a display panel 300 while the processor 100 is activated. In the first operating mode, the DDIC 200 may be supplied with sufficient power to operate without any functional limitation.

In the second operating mode, the DDIC 200 may read image data from an internal memory and display the image data on the display panel 300 while the processor 100 is deactivated. In the second operating mode, one or more components of the DDIC 200 may be deactivated, so that the DDIC 200 may operate with some functional limitation.

In the second operating mode, the processor 100 may be temporarily activated when an internal memory update condition is satisfied. For example, when information to be displayed on the display panel 300 is changed, the processor 100 may be temporarily activated to transmit new image data. When the processor 100 is activated, the DDIC 200 may store the image data received from the processor 100 in the internal memory, and display the image data read from the internal memory on the display panel 300.

In an exemplary embodiment, the internal memory update condition may include a case in which an event triggered by a user, e.g., generation of a user input via a button or a touch panel, occurs, a case in which an event interrupted on an electronic device, such as reception of a push message of an application, occurs, a case in which a certain cycle happens, etc. For example, in the second operating mode, the processor 100 may be activated every hour to transmit image data representing weather information to the display panel 300. In addition, when receiving external data, e.g., a short message service (SMS) message, the processor 100 may be activated to transmit image data representing contents of the received message to the display panel 300. Such an internal memory update condition may be set and changed by a user or a designer.

Referring to FIG. 4, the DDIC 200 may include an interface 210, an image processor 220, a controller 230, a timing controller 240, a gate driver 250, and a source driver 260. The DDIC 200 may further include a first memory 270 as an internal memory.

The DDIC 200 may receive image data from the processor 100 via the interface 210. The DDIC 200 may further receive a timing control signal from the processor 100 via the interface 210. The timing control signal may include information regarding a horizontal period and a vertical period related to the gate driver 250 and the source driver 260.

The interface 210 may include a data lane to transmit and receive the image data, and a clock lane to transmit and receive the timing control signal. In an exemplary embodiment, the interface 210 may be a high-speed serial interface such as, for example, the MIPI. Alternatively, the interface 210 may be one of interfaces according to various standards such as, for example, a mobile display digital interface (MDDI), an embedded display port, etc.

The interface 210 may be operated with different clocks according to an operating mode of the DDIC 200. In an exemplary embodiment, when the DDIC 200 operates in the first operating mode, the interface 210 may be operated with a first clock. When the DDIC 200 operates in the second operating mode, the interface 210 may be operated with a second clock having a frequency lower than that of the first clock. For example, in an exemplary embodiment, the interface 210 may be operated with a 64 MHz clock in the first operating mode and may be operated with a 32 MHz clock in the second operating mode. Thus, the operating clock for the interface 210 may be changed when a switch is made from the first operating mode to the second operating mode (e.g., based on a mode switching signal MODE_CTRL, which is described in further detail below).

A transmission rate of the interface 210 may vary according to the operating mode of the DDIC 200. In an exemplary embodiment, the transmission rate of the interface 210 in the first operating mode may be higher than that of the interface 210 in the second operating mode. For example, the transmission rate of the interface 210 may be about 500 Mbps in the first operating mode and may be about 400 Mbps in the second operating mode. The interface 210 may be operated with a lower transmission rate in the second operating mode than in the first operating mode to prevent a tearing effect that may occur when the speed of updating image data in the internal memory becomes faster than that of reading the image data. Thus, image data transmitted in the second operating mode may be transmitted at a lower transmission rate than image data transmitted in the first operating mode.

When operating mode switching occurs, a clock and transmission rate of the interface 210 may be changed under control of the controller 230. In an exemplary embodiment, the controller 230 may change the clock and transmission rate of the interface 210 before the operating mode switching is completed. For example, when the first operating mode is switched to the second operating mode, the controller 230 may change the first clock for the interface 210 to the second clock before the interface 210 is deactivated. In addition, when the second operating mode is switched to the first operating mode, the controller 230 may change the second clock for the interface 210 to the first clock before the interface 210 is activated. The controller 230 may change the clock and transmission rate of the interface 210 before the operating mode switching is completed, thereby preventing a transmission delay. Thus, the controller 230 may control whether to activate the interface 210 according to the operating mode of the DDIC 200.

In the first operating mode, the image data received from the processor 100 may be input to the image processor 220. The timing control signal received from the processor 100 may be input to the timing controller 240.

When the first operating mode is switched to the second operating mode, the image data received from the processor 100 may be stored in the first memory 270. In the second operating mode, the processor 100 may be activated only when a certain operating condition is satisfied, and the image data received from the activated processor 100 may be stored in the first memory 270. For example, when a message is received or a certain cycle happens, the DDIC 200 may update the image data stored in the first memory 270 with the image data received from the processor 100.

The image processor 220 may improve the quality of the image data by compensating for deterioration of the display panel 300. The image processor 220 may include a pixel data processing circuit, a pre-processing circuit, a gamma correction circuit, etc.

In the first operating mode, the image processor 220 may correct image data to be input to the display panel 300 on the basis of the correction data stored in the first memory 270.

The image data may be a certain range of digital value such as, for example, an 8-bit value, a 10-bit value, or a 16-bit value, and the correction data may include bit information of image data to be changed to improve image quality. For example, the correction data may include index information of bits to be changed among bit values included in the image data.

The correction data may be set in advance in consideration of panel characteristics of the display panel 300, process parameters, etc., and be stored in a second memory 400, which is disposed outside of the DDIC 200. In an exemplary embodiment, the second memory 400 is an external memory of the DDIC 200, and may be a nonvolatile memory such as, for example, a NAND flash memory. The correction data stored in the second memory 400 may be copied to the first memory 270 included in the DDIC 200 when the DDIC 200 enters into the first operating mode.

The controller 230 may control the DDIC 200 to display certain image data on the display panel 300 according to the operating mode of the DDIC 200.

For example, in the first operating mode, the controller 230 may control the image processor 220 to correct the image data received from the processor 100 on the basis of the correction data stored in the first memory 270. In addition, the controller 230 may control the timing controller 240 to input the corrected image data to the display panel 300. In this case, the timing controller 240 may control the gate driver 250 and the source driver 260 using the timing control signal generated by the processor 100.

In the second operating mode, the controller 230 may control the first memory 270 to store image data, among image data received from the processor 100, that is not displayed on the display panel 300. In addition, the controller 230 may control the timing controller 240 to input the image data stored in the first memory 270 to the display panel 300. In this case, the timing controller 240 may control the gate driver 250 and the source driver 260 using a horizontal period and a vertical period which are determined by the timing controller 240.

In the second operating mode, when the internal memory update condition is satisfied, the controller 230 may control the first memory 270 to store the image data received from the processor 100. In an exemplary embodiment, the internal memory update condition may include a case in which a certain event such as reception of a message, occurs, a case in which a certain cycle happens, etc., and may be preset and changed variously by a user or a designer.

In the second operating mode, when the internal memory update condition is satisfied, the controller 230 may transmit a control signal to the interface 210 so as to temporarily activate the processor 100 and the interface 210. In this case, the interface 210 may transmit the control signal to the processor 100, and the processor 100 may be temporarily activated to transmit image data to be updated, in response to the control signal. In the second operating mode, the image data received from the processor 100 may be stored in the first memory 270.

In an exemplary embodiment, the image data stored in the first memory 270 may be data compressed using an image compression algorithm. For example, in the second operating mode, the image data received from the processor 100 may be compressed using a High Efficiency Video Coding (HEVC) algorithm, a Future Video Coding (FVC) algorithm, etc., and stored in the first memory 270.

The operating mode of the DDIC 200 may be switched when a certain mode switching condition is satisfied. In an exemplary embodiment, the mode switching condition may include a case in which a motion of an electronic device including the DDIC 200 has a predetermined pattern, a case in which a user input is generated via a touch panel or the like, a case in which a user input does not occur for a certain time period or longer, a case in which a battery power level decreases to a predetermined threshold or less, a case in which the number of output frames of image data is greater than or equal to a predetermined threshold, etc.

When the operating mode of the DDIC 200 is switched, the controller 230 may control the operations of the components using a mode switching signal MODE_CTRL. In an exemplary embodiment, when the mode switching signal MODE_CTRL changes from logic high to logic low, the operating mode of the DDIC 200 may be switched from the first operating mode to the second operating mode. When the mode switching signal MODE_CTRL changes from logic low to logic high, the operating mode of the DDIC 200 may be switched from the second operating mode to the first operating mode. In each of the above cases, a point of time when the mode switching signal MODE_CTRL changes may be regarded as a point of time when operating mode switching is requested. A relationship between the mode switching signal MODE_CTRL and operating mode switching is described with reference to FIG. 5. In an exemplary embodiment, the mode switching signal MODE_CTRL may be received from the processor 100 when the DDIC 200 operates in the first operating mode, and may be generated by the controller 230 when the DDIC 200 operates in the second operating mode.

In an exemplary embodiment, the operating mode of the DDIC 200 may be switched from the first operating mode to the second operating mode when the mode switching signal MODE_CTRL changes from logic low to logic high (instead of from logic high to logic low).

In an exemplary embodiment, second image data 22 (refer to FIG. 1) received from the processor 100 may be stored in the first memory 170 in response to the DDIC 200 receiving the mode switching signal MODE_CTRL that causes the DDIC 200 to switch from the first operating mode (e.g., a normal mode) to the second operating mode (e.g., a sleep mode). The second image data 22 may be displayed on the display panel 300 in the second operating mode (e.g., a sleep mode).

Figure 5:
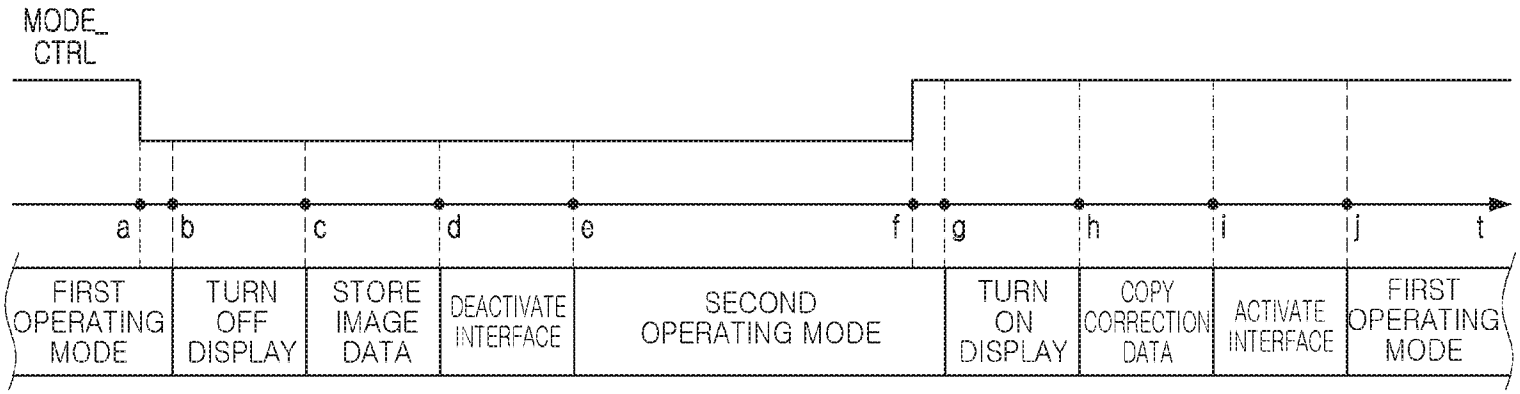
FIG. 5 is a diagram illustrating a process of switching between operating modes according to a mode switching signal, the process being performed by a DDIC, according to an exemplary embodiment.

FIG. 5 illustrates a case in which the DDIC 200 operates in an order of the first operating mode, the second operating mode, and the first operating mode.

Referring to FIG. 5, in the first operating mode, the mode switching signal MODE_CTRL may be logic high.

When a mode change event of switching from the first operating mode to the second operating mode occurs, under control of a user or the processor 100 (operation a), the mode switching signal MODE_CTRL may change from logic high to logic low. In this case, the controller 230 may turn off a display (operation b), store image data received from the processor 100 in the first memory 270 (operation c), and deactivate the interface 210 (operation d). When the interface 210 is deactivated, mode switching is completed and the DDIC 200 operates in the second operating mode (operation e).

When a mode change event of switching from the second operating mode to the first operating mode occurs, under control of the user or the processor 100 (operation f), the mode switching signal MODE_CTRL may change from logic low to logic high. In this case, the controller 230 may turn on the display (operation g), copy the correction data stored in the second memory 400 to the first memory 270 (operation h), and activate the interface 210 (operation i). When the interface 210 is activated, mode switching is completed and the DDIC 200 operates in the first operating mode (operation j).

The timing controller 240 may control the gate driver 250 and the source driver 260 to input image data to pixels of the display panel 300.

The timing controller 240 may control operation timings of the gate driver 250 and the source driver 260 using the timing control signal. In the first operating mode, the timing control signal may be generated by the processor 100 and transmitted to the timing controller 240. In contrast, in the second operating mode, the timing control signal may be generated by the timing controller 240. That is, in the second operating mode, the timing controller 240 may control the gate driver 250 and the source driver 260 using the horizontal period and the vertical period, which are determined by the timing controller 240. Thus, while operating in the second operating mode, displaying image data on the display panel 300 may be performed under timing control of the DDIC 200. Thus, in an exemplary embodiment, the corrected first image data 21 (refer to FIG. 1) may be displayed on the display panel 300 in the first operating mode under timing control of the processor 100, and the second image data 22 (refer to FIG. 1) may be displayed on the display panel 300 in the second operating mode under timing control of the DDIC 200 (via the timing controller 240 included in the DDIC 200).

Although the controller 230 and the timing controller 240 are illustrated as separate components in FIG. 4, exemplary embodiments are not limited thereto. For example, in an exemplary embodiment, the controller 230 and the timing controller 240 may be integrally formed as a single component.

Figure 6:
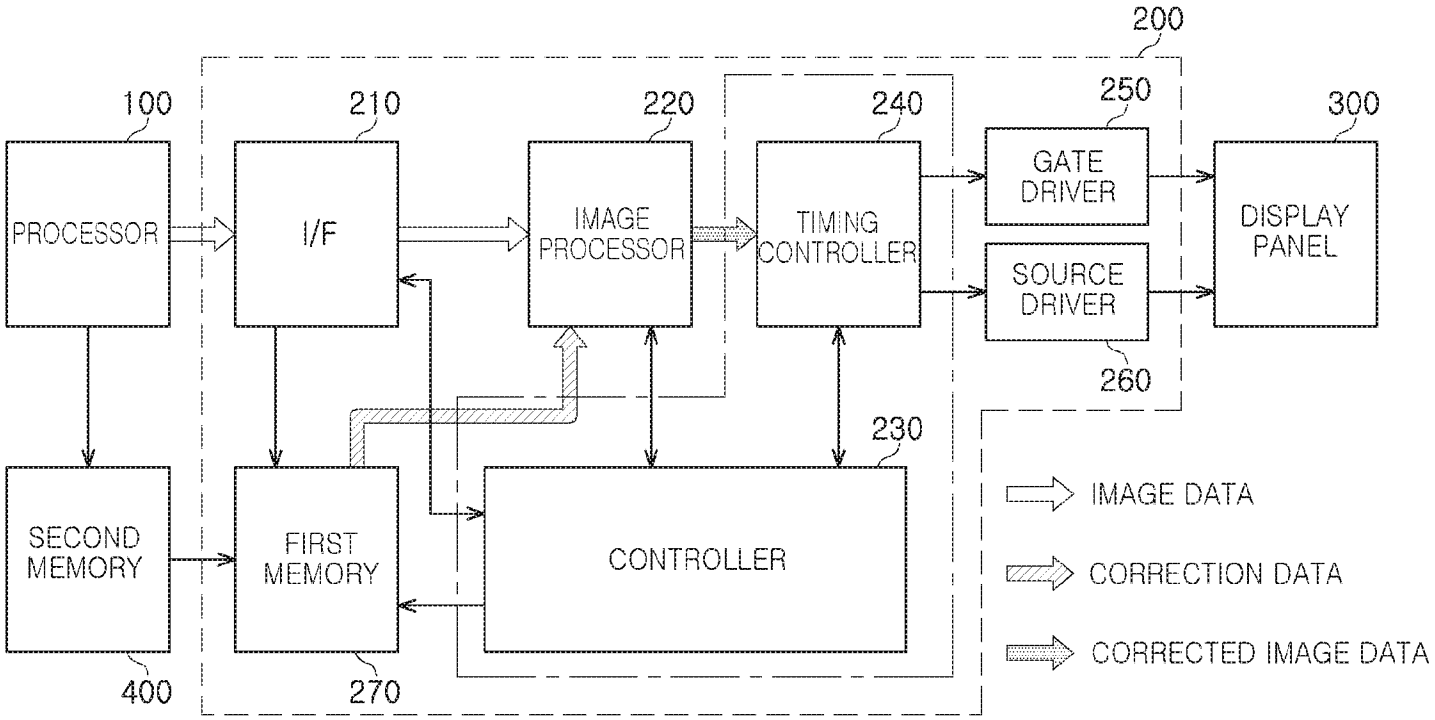
FIGS. 6 and 7 are diagrams illustrating operations of a DDIC according to an exemplary embodiment.
Figure 7:
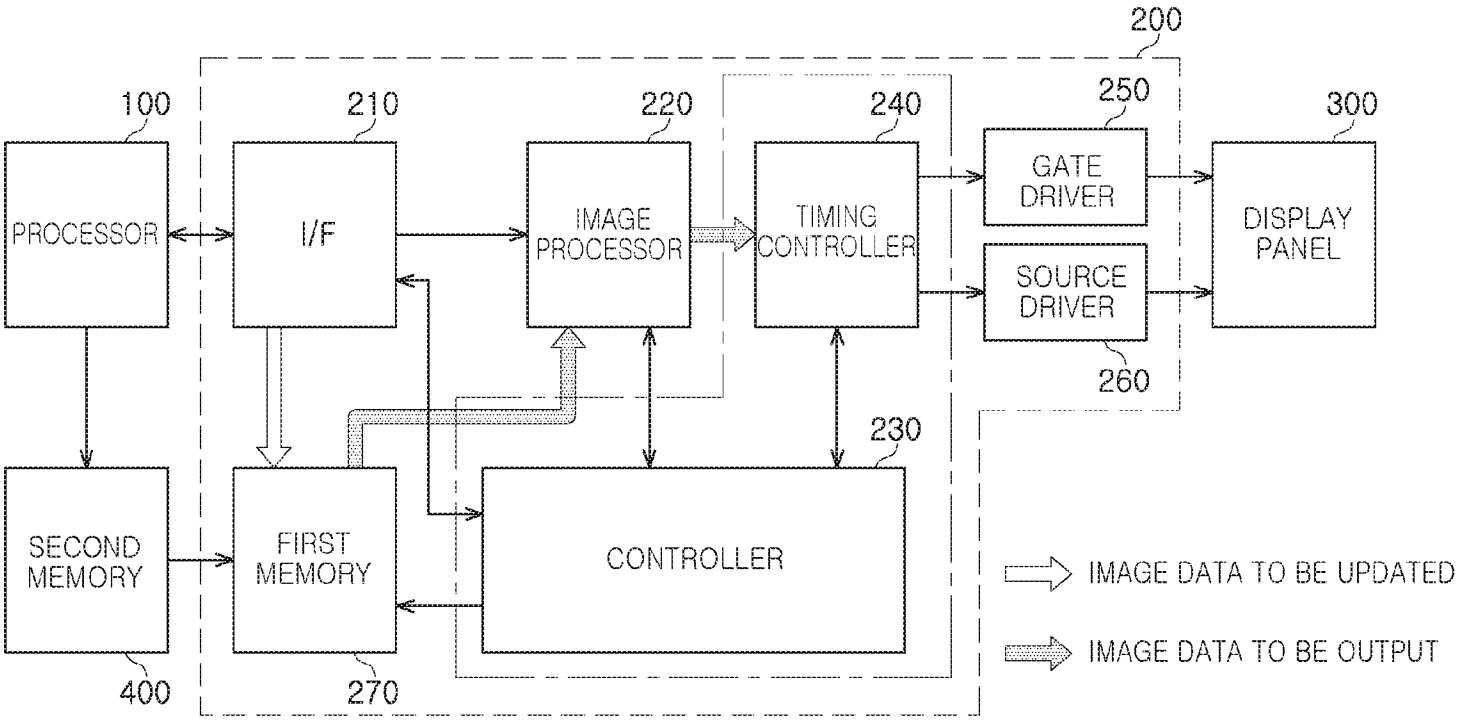

FIGS. 6 and 7 are diagrams illustrating operations of a DDIC according to an exemplary embodiment.

FIG. 6 illustrates a process of displaying image data when the DDIC operates in the first operating mode (e.g., the normal mode).

Referring to FIG. 6, in the first operating mode, all components of a processor 100 and a DDIC 200 may be activated.

Image data received from the processor 100 via an interface 210 may be input to an image processor 220.

When the DDIC 200 enters the first operating mode, correction data stored in a second memory 400 may be copied to a first memory 270. In this case, the first memory 270 may be used as a look-up table for correcting image data to improve image quality.

The correction data stored in the first memory 270 may be input to the image processor 220 under control of a controller 230.

The image processor 220 may correct the image data on the basis of the correction data stored in the first memory 270. In an exemplary embodiment, the correction data may include index information of at least one bit to be changed among bit values included in the image data. The correction data may be set in advance in consideration of panel characteristics of a display panel 300, process parameters, etc., and stored in a second memory 400 outside the DDIC 200.

The image processor 220 may output the corrected image data to the timing controller 240.

The timing controller 240 may control a gate driver 250 and a source driver 260 using a timing control signal received from the processor 100 to display the corrected image data on the display panel 300.

FIG. 7 illustrates a process of displaying image data when the DDIC operates in the second operating mode (e.g., the sleep mode).

Referring to FIG. 7, in the second operating mode, some components of the processor 100 and the DDIC 200 may be deactivated. For example, the processor 100 and the interface 210 may be deactivated in the second operating mode.

When the DDIC 200 enters the second operating mode, image data received from the processor 100 via the interface 210 may be copied to the first memory 270. In this case, the first memory 270 may be used as a display buffer. Thus, rather than implementing a separate memory in a DDIC for the purpose of operating as a display buffer in a sleep mode, as is the case according to a comparative example, the first memory 270 may be utilized in a sleep mode as a display buffer according to exemplary embodiments.

In an exemplary embodiment, when a certain internal memory update condition is satisfied, image data stored in the first memory 270 may be updated with the image data received from the processor 100. For example, when a certain cycle happens or an event such as reception of a message occurs, the controller 230 may temporarily activate the interface 210 and control the first memory 270 to store the image data received from the processor 100.

The controller 230 may transmit the image data stored in the first memory 270 to the timing controller 240 via the image processor 220.

The timing controller 240 may display the image data on the display panel 300 by controlling the gate driver 250 and the source driver 260 using a horizontal period and a vertical period, which are determined by the timing controller 240.

Figure 8:
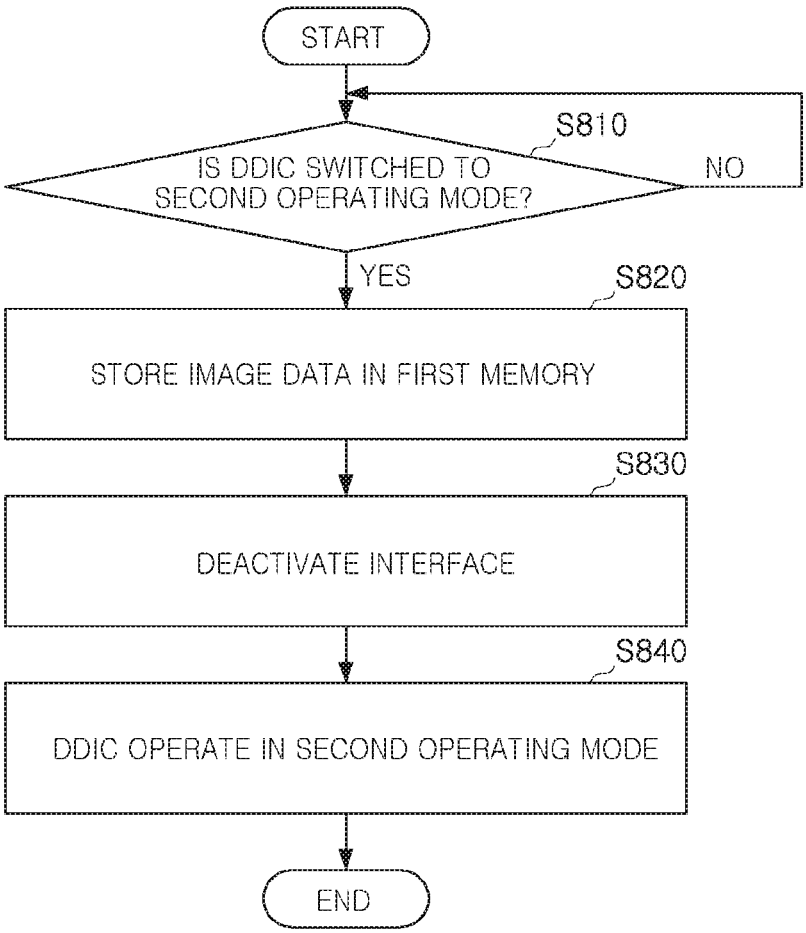
FIGS. 8 and 9 are flowcharts illustrating processes of switching between operating modes, the processes being performed by a DDIC, according to exemplary embodiments.
Figure 9:
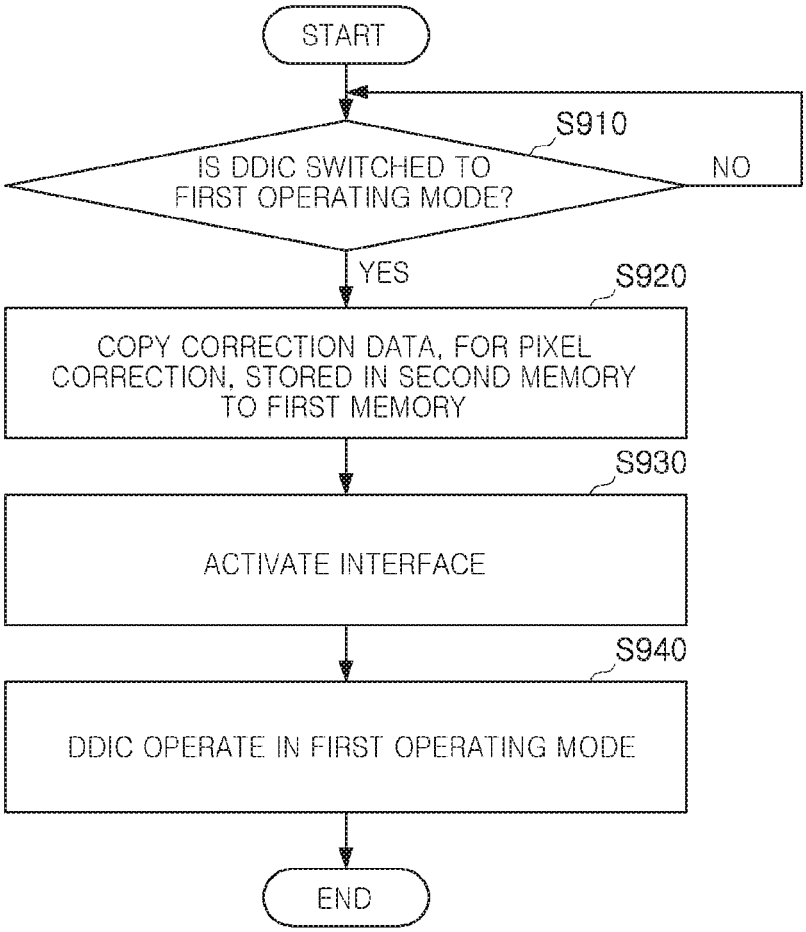

FIGS. 8 and 9 are flowcharts illustrating processes of switching between operating modes, the process being performed by a DDIC, according to exemplary embodiments.

FIG. 8 illustrates a process of switching the DDIC from the first operating mode to the second operating mode.

Referring to FIG. 8, in operation S810, the controller 230 may identify whether the DDIC 200 is switched from the first operating mode to the second operating mode. In an exemplary embodiment, the controller 230 may identify whether the DDIC 200 is switched from the first operating mode to the second operating mode by identifying whether a mode switching signal MODE_CTRL changes. For example, when the mode switching signal MODE_CTRL changes from logic high to logic low, it may be determined that the DDIC 200 is switched from the first operating mode to the second operating mode.

In operation S820, when it is determined in operation S810 that the DDIC 200 is switched to the second operating mode (when 'yes'), the first memory 270 may store image data received from the processor 100, and the process may proceed to operation S830. In an exemplary embodiment, the image data stored in the first memory 270 may be image data received from the processor 100 when the mode switching signal MODE_CTRL changes.

In the second operating mode, the use of the first memory 270 for storing correction data to be used to correct image data in the first operating mode may be switched to perform a function of a display buffer to store image data to be displayed on the display panel 300.

In an exemplary embodiment, the image data may include a plurality of frames. In this case, the image data stored in the first memory 270 may include at least one frame, among a plurality of frames received from the processor 100, which is not displayed on the display panel 300. The frames received from the processor 100 may be sequentially displayed on the display panel 300. In this case, image data received later than the image data displayed on the display panel 300 may be stored in the first memory 270.

In an exemplary embodiment, the first image data 21 (refer to FIG. 1) includes a plurality of frames, and the second image data 22 (refer to FIG. 1) includes at least one frame, among the plurality of frames, which is not displayed on the display panel 300.

In an exemplary embodiment, the first image data 21 (refer to FIG. 1), which is received from the processor 100 and includes a plurality of image frames, is corrected using correction data stored in the first memory 270 and is displayed on the display panel 300. At least one image frame from among the plurality of image frames in the first memory 270, which is not displayed on the display panel 300, is stored as the second image data 22 (refer to FIG. 1), in response to the mode switching signal MODE_CTRL. The second image data 22 may be updated using third image data received from the processor 100 in response to an update condition, such as the update conditions described above, being satisfied.

In an exemplary embodiment, the image data stored in the first memory 270 may be data compressed using an image compression algorithm. For example, in the second operating mode, the image data received from the processor 100 may be compressed using the HEVC algorithm, the FVC algorithm, etc., and then stored in the first memory 270.

When it is determined in operation S810 that the DDIC 200 is not switched to the second operating mode (e.g., when the DDIC 200 is not currently in the second operating mode) (when 'no'), the controller 230 may repeat operation S810 until it is determined that the DDIC 200 is switched to the second operating mode.

In operation S830, the controller 230 may deactivate the interface 210. When the interface 210 is deactivated, the process of switching from the first operating mode to the second operating mode may be completed.

In the second operating mode, the processor 100 and the interface 210 may be temporarily activated when a certain internal memory update condition is satisfied. In this case, the DDIC 200 may receive the image data from the processor 100 via the temporarily activated interface 210 and store the image data in the first memory 270.

In operation S840, the DDIC 200 may operate in the second operating mode and display the image data stored in the first memory 270 on the display panel 300.

Table 1 below shows results of simulating power consumption of a DDIC with a separate display buffer in a sleeping mode according to a comparative example, and power consumption of a DDIC according to an exemplary embodiment.

TABLE 1

| Display Pattern | Separate Display Buffer for Sleep Mode Included? | 1.5 V Digital Power Source (mW) | 1.8 V Interface Power Source (mW) | 3.0 V Analog Power Source 1 (mW) | 7.6 V Analog Power Source 2 (mW) | Total Power Consumption of DDI (mW) |
|---|---|---|---|---|---|---|
| All White | Included | 20.57 | 7.70 | 4.70 | 46.55 | 79.52 |
| | Not Included | 15.64 | 0.24 | 4.67 | 46.44 | 66.99 |
| All Black | Included | 19.07 | 7.67 | 4.92 | 43.13 | 74.79 |
| | Not Included | 14.70 | 0.24 | 4.91 | 43.02 | 62.86 |
| Checker Board (2 × 2) | Included | 31.37 | 8.33 | 4.83 | 75.96 | 120.48 |
| | Not Included | 23.23 | 0.26 | 4.79 | 75.54 | 103.81 |
| User Interface | Included | 22.56 | 8.91 | 4.76 | 56.81 | 93.04 |
| | Not included | 19.01 | 0.28 | 4.74 | 56.62 | 80.65 |

Table 1 shows a result of simulating measurement of power consumption of each of the above DDICs while changing a display pattern of the display panel 300 to four types (all white, all black, 2×2 checker board, and user interface), under operating conditions of 1.2 Gbps and 30 fps. In Table 1, "all white" indicates a white background, "all black" indicates a black background, "2×2 checker board" indicates a black-and-white checker board having a size of 2×2, and "user interface" indicates a user interface screen containing time information, date information, etc.

Table 1 shows that power consumption of each internal power source of each of the DDICs and total power consumption of each of the DDICs with respect to all four display patterns were reduced by about 10% or higher when the separate display buffer for the sleep mode is not included, compared to when the display buffer is included. As described above, in a DDIC according to an exemplary embodiment, a separate display buffer for the sleep mode is not included, and rather, an internal memory for storing correction data may be used as a display buffer for the sleep mode, thereby reducing power consumption.

FIG. 9 illustrates a process of switching a DDIC from the second operating mode to the first operating mode.

Referring to FIG. 9, in operation S910, the controller 230 may identify whether the DDIC 200 is switched from the second operating mode to the first operating mode.

In operation S920, when it is determined in operation S910 that the DDIC 200 is switched to the first operating mode (when 'yes'), the controller 230 may copy correction data stored in the second memory 400 to the first memory 270, and then the process may proceed to operation S930.

In the first operating mode, the use of the first memory 270 for storing image data to be displayed on the display panel 300 in the second operating mode may be switched to perform a function of a look-up table to be used to correct the image data. As described above, in the DDIC 200 according to an exemplary embodiment, one internal memory 270 may be used as an image correction memory or a buffer memory according to an operating mode, thereby reducing the size and power consumption of the DDIC 200.

When it is determined in operation S910 that the DDIC 200 is not switched to the first operating mode (e.g., when the DDIC 200 is not currently in the first operating mode) (when 'no'), the controller 230 may repeat operation S910 until it is determined that the DDIC 200 is switched to the first operating mode.

In operation S930, the controller 230 may activate the interface 210. When the interface 210 is activated, the process of switching from the second operating mode to the first operating mode may be completed.

In operation S940, the DDIC 200 may operate in the first operating mode and display image data received from the processor 100 via the interface 210 on the display panel 300.

In the first operating mode, the DDIC 200 may continuously receive a plurality of pieces of image data from the processor 100. In this case, the controller 230 may sequentially display the image data continuously received from the processor 100 on the display panel 300.

Figure 10:
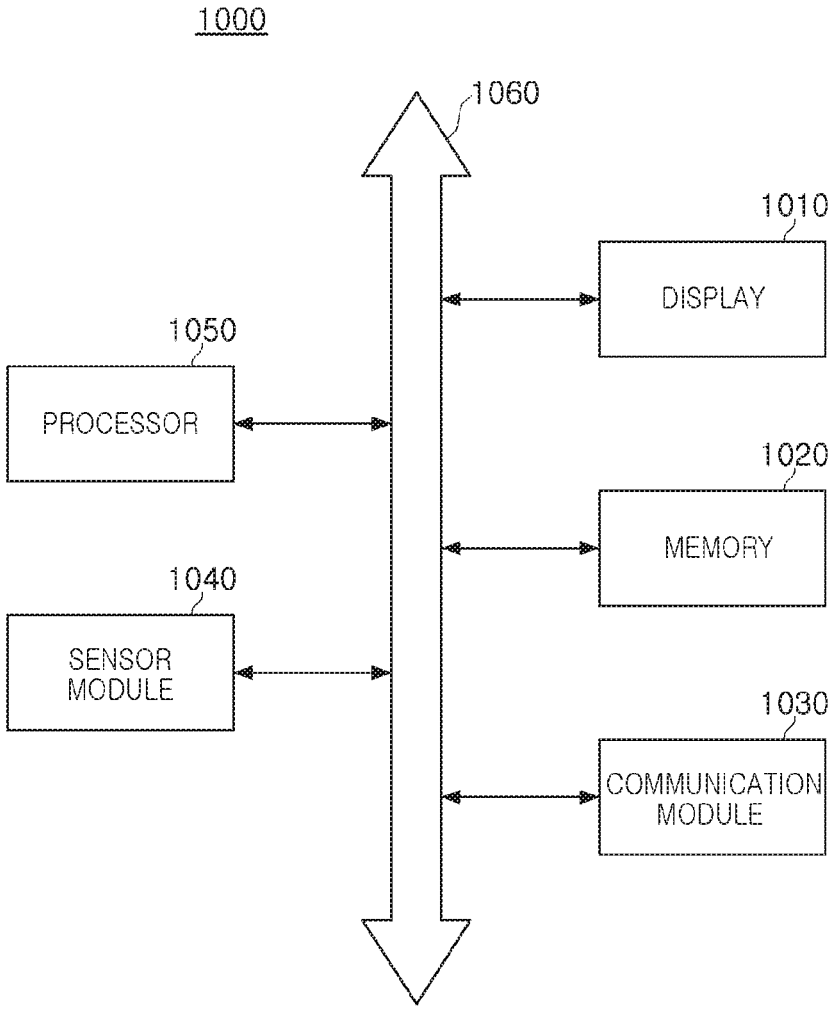
FIG. 10 is a block diagram of an electronic device including a display device according to an exemplary embodiment.

FIG. 10 is a block diagram of an electronic device including a display device according to an exemplary embodiment.

Referring to FIG. 10, an electronic device 1000 according to an exemplary embodiment may include a display 1010, a memory 1020, a communication module 1030, a sensor module 1040, a processor 1050, etc. Examples of the electronic device 1000 may include not only mobile devices such as, for example, a smartphone, a tablet PC, and a laptop computer, but also, for example, a television, a desktop computer, etc. Components such as the display 1010, the memory 1020, the communication module 1030, the sensor module 1040, and the processor 1050 may communicate with one another via a bus 1060.

The display 1010 may include a DDIC and a display panel. In an exemplary embodiment, the DDIC uses an internal memory, which is used as a look-up table for image correction in the normal mode, as a display buffer for storing image data in the sleep mode, and is thus capable of processing image data in the sleep mode without using a separate display buffer. Furthermore, the DDIC may use the internal memory as a look-up table for image correction or a display buffer according to an operating mode, thereby reducing the size and power consumption of the DDIC.

As is traditional in the field of the present disclosure, exemplary embodiments are described, and illustrated in the drawings, in terms of functional blocks, units and/or modules. Those skilled in the art will appreciate that these blocks, units and/or modules are physically implemented by electronic (or optical) circuits such as logic circuits, discrete components, microprocessors, hard-wired circuits, memory elements, wiring connections, etc., which may be formed using semiconductor-based fabrication techniques or other manufacturing technologies. In the case of the blocks, units and/or modules being implemented by microprocessors or similar, they may be programmed using software (e.g., microcode) to perform various functions discussed herein and may optionally be driven by firmware and/or software.

As set forth above, in a DDIC according to an exemplary embodiment, an internal memory used as a look-up table for image correction in the normal mode is used as an image data storage memory in the sleep mode, and thus, image data may be processed without a separate display buffer in the sleep mode.

In addition, in the DDIC according to an exemplary embodiment, the internal memory may be used as either the look-up table for image correction or a display buffer according to an operating mode, thereby reducing the size and power consumption of the DDIC.

While the present disclosure has been particularly shown and described with reference to the exemplary embodiments thereof, it will be understood by those of ordinary skill in the art that various changes in form and detail may be made therein without departing from the spirit and scope of the present disclosure as defined by the following claims.

What is claimed is:

1. An operating method of a display driving integrated circuit (DDIC), the operating method comprising:

correcting first image data using correction data in a first operating mode, wherein the first image data is received from a processor via an interface, and the correction data is stored in a first memory included in the DDIC in the first operating mode;

storing second image data received from the processor in the same first memory included in the DDIC in a second operating mode, in response to a mode switching signal controlling the DDIC to switch to the second operating mode; and displaying the second image data on a display panel in the second operating mode.

2. The operating method of claim 1, further comprising:

updating the second image data with third image data in the second operating mode, wherein the third image data is received from the processor.

3. The operating method of claim 1, wherein the first image data comprises a plurality of frames, and the second image data comprises at least one frame, among the plurality of frames, which is not displayed on the display panel.

4. The operating method of claim 1, further comprising:

deactivating the interface in response to the mode switching signal controlling the DDIC to switch to the second operating mode.

5. The operating method of claim 1, wherein a frequency of an operating clock for the interface in the second operating mode is lower than a frequency of an operating clock for the interface in the first operating mode.

6. The operating method of claim 1, further comprising:

changing an operating clock for the interface in response to the mode switching signal controlling the DDIC to switch to the second operating mode.

7. The operating method of claim 1, further comprising:

copying correction data stored in a second memory disposed outside the DDIC to the first memory, in response to the mode switching signal controlling the DDIC to switch to the first operating mode.

8. The operating method of claim 1, wherein the correction data comprises bit index information for correcting at least some of bit values included in the first image data.

9. The operating method of claim 1, wherein a timing controller in the DDIC inputs the first image data to the display panel in response to a timing control signal, wherein a controller in the DDIC controls whether to activate the interface according to an operating mode of the DDIC, wherein the timing control signal is received from the processor when the DDIC operates in the first operating mode, and is generated by the controller when the DDIC operates in the second operating mode.

10. An operating method of a display driving integrated circuit (DDIC), the operating method comprising:

receiving first image data and second image data from a processor via an interface;

obtaining correction data stored in an internal memory of the DDIC;

correcting the first image data using the correction data;

displaying the corrected first image data on a display panel; and deactivating the interface and storing the second image data in the same internal memory instead of the correction data.

11. The operating method of claim 10, wherein the first image data is received earlier than the second image data.

12. The operating method of claim 10, further comprising:

displaying the second image data on the display panel under timing control of the DDIC.

13. The operating method of claim 10, further comprising:

updating the second image data with third image data received from the processor.

14. The operating method of claim 13, wherein a transmission rate of the third image data is lower than a transmission rate of the first image data and a transmission rate of the second image data.

15. The operating method of claim 10, further comprising:

storing, in the same internal memory, the correction data stored in an external memory in response to a mode switching signal.

16. The operating method of claim 15, wherein the mode switching signal changes from logic low to logic high.

17. A display driving integrated circuit (DDIC), comprising:

an interface that communicates with a processor;

a first memory that stores either correction data for correcting image data received from the processor or the image data, wherein the first memory is connected to the interface;

a timing controller that inputs the image data to a display panel in response to a timing control signal; and a controller that controls whether to activate the interface according to an operating mode of the DDIC, wherein the timing control signal is received from the processor when the DDIC operates in a first operating mode, and is generated by the controller when the DDIC operates in a second operating mode.

18. The DDIC of claim 17, wherein the first memory stores the correction data when the DDIC operates in the first operating mode.

19. The DDIC of claim 17, wherein the first memory stores the image data when the DDIC operates in the second operating mode.

20. The DDIC of claim 17, wherein the controller changes an operating clock for the interface when the operating mode of the DDIC is changed.

* * * * *